US007624542B2

(12) United States Patent
Hatrick-Smith

(10) Patent No.: US 7,624,542 B2
(45) Date of Patent: Dec. 1, 2009

(54) SHOWER OR BATH WALL PANEL AND METHOD OF FORMING SAME

(75) Inventor: John Hatrick-Smith, Glenfield (NZ)

(73) Assignee: Kohler New Zealand Limited, Auckland (NZ)

( * ) Notice: Subject to any disclaimer, the term of this patent is extended or adjusted under 35 U.S.C. 154(b) by 0 days.

(21) Appl. No.: 10/576,397

(22) PCT Filed: Oct. 22, 2004

(86) PCT No.: PCT/NZ2004/000265

§ 371 (c)(1),
(2), (4) Date: Apr. 13, 2007

(87) PCT Pub. No.: WO2005/037041

PCT Pub. Date: Apr. 28, 2005

(65) Prior Publication Data

US 2007/0266646 A1 Nov. 22, 2007

(30) Foreign Application Priority Data

Oct. 22, 2003 (NZ) ..... 529079

(51) Int. Cl.
*A47K 3/16* (2006.01)
*A47K 3/28* (2006.01)
*E04F 19/00* (2006.01)

(52) U.S. Cl. ..... 52/35; 52/36.4; 52/36.5; 4/574.1; 4/605

(58) Field of Classification Search ..... 52/27, 52/35, 36.4, 36.5, 261; 4/574.1, 605
See application file for complete search history.

(56) References Cited

U.S. PATENT DOCUMENTS

| | | | | | |
|---|---|---|---|---|---|
| 3,751,737 | A * | 8/1973 | Mustee | 4/608 |
| 4,423,528 | A * | 1/1984 | Wiedmeier | 4/613 |
| 4,553,276 | A * | 11/1985 | Paradis | 4/612 |
| 4,817,344 | A * | 4/1989 | Wissinger | 52/35 |
| 4,901,380 | A * | 2/1990 | Smith | 4/596 |
| 4,912,782 | A | 4/1990 | Robbins | |
| 4,993,201 | A * | 2/1991 | Bunyard | 52/35 |

(Continued)

FOREIGN PATENT DOCUMENTS

CA 2 305 988 10/2001

(Continued)

OTHER PUBLICATIONS

International Search Report corresponding to PCT/NZ2004/000265, under date of mailing of Feb. 23, 2005.

*Primary Examiner*—Richard E Chilcot, Jr.
*Assistant Examiner*—Mark R Wendell
(74) *Attorney, Agent, or Firm*—Quarles & Brady LLP

(57) ABSTRACT

A shower or bath wall liner panel 1 includes panel sections on either side of a fold 4 down the panel, and opposing non-planar formations 7 and 8 integrally formed in the panel on either side of the fold 4 from which after installation of the liner panel one or more of a shelf, soap dish, flannel rail, or a step 10 may be supported within a shower enclosure or above a bath or which form integrally one or more of a shelf or basket, soap dish, flannel rail, or step.

13 Claims, 8 Drawing Sheets

U.S. PATENT DOCUMENTS

| | | | | |
|---|---|---|---|---|
| 5,070,549 | A * | 12/1991 | Campe | 4/596 |
| 5,276,926 | A | 1/1994 | Lopez | |
| 5,337,525 | A * | 8/1994 | Zaccai et al. | 52/35 |
| 5,537,696 | A | 7/1996 | Chartier | |
| 5,647,072 | A * | 7/1997 | Shaffer et al. | 4/574.1 |
| 5,671,489 | A * | 9/1997 | Salach | 4/614 |
| 6,289,529 | B1 * | 9/2001 | Harvey | 4/605 |
| 6,425,147 | B1 * | 7/2002 | Hanson | 4/584 |
| 6,698,037 | B2 * | 3/2004 | Lippe | 4/612 |
| 2002/0053105 | A1 | 5/2002 | Turner | |
| 2005/0086736 | A1 * | 4/2005 | Helmetsie et al. | 4/596 |
| 2009/0077903 | A1 * | 3/2009 | Madesh | 52/36.4 |

FOREIGN PATENT DOCUMENTS

| | | |
|---|---|---|
| JP | 09-010272 | 1/1997 |
| JP | 2002209967 | 7/2002 |
| JP | 2002238788 | 8/2002 |

* cited by examiner

SHOWER OR BATH WALL PANEL AND METHOD OF FORMING SAME

CROSS-REFERENCE TO RELATED APPLICATIONS

This application claims priority of PCT Patent Application PCT/NZ2004/000265, filed 22 Oct. 2004, which claims priority of New Zealand Patent Application Number 529079 filed 22 Oct. 2003.

FIELD OF INVENTION

The invention relates to a shower or bath wall liner panel and method of forming same.

BACKGROUND OF THE INVENTION

When for example a door and return panel are fitted in the corner of a bathroom or similar to provide a shower enclosure, the existing corner walls of the room which together with the door and return panel define the shower enclosure, must be lined with an appropriate waterproof lining. Bathroomware manufacturers sell wall liner panels which comprise a one piece sheet with a right angle fold down the sheet, which may be fitted in place to line the two intersecting walls of the bathroom where the shower is to be situated, before the door and return panel are then installed. Typically these wall panels are formed from a plastics sheet material. A right angle centre fold is formed in a standard size sheet in the factory, and the sheet may be flex-folded further to reduce it's volume and is packaged in a cardboard carton. At an installation site the wall liner panel is removed from the carton, and is opened and installed in position over or in place of the pre-existing wall lining in the corner of the bathroom, before a door and one or more return panels are fitted.

Similar right angle folded wall liner panels are sold for lining the corner walls of a bathroom above a bath positioned in a corner of the bathroom.

With such wall liner panels it is also known to form a shelf compartment in the panel on one side of the centre fold, typically by vacuum forming.

It is further known with such wall liner panels to form the centre fold as a w-fold to provide a volume in which a vertically extending shelf compartment can in turn be formed in the corner of the panel. A disadvantage of this design is that an open space is left at the top of (and bottom) of the wall liner panel. Typically during installation this is packed, with polystyrene for example.

SUMMARY OF THE INVENTION

The invention provides an improved or at least alternative shower or bath wall liner panel, and method of forming same.

In broad terms the invention comprises a shower or bath wall liner panel including panel sections on either side of a fold down the panel, and opposing non-planar formations integrally formed in the panel on either side of the fold from which after installation of the liner panel one or more of a shelf, soap dish, flannel rail, or a step may be supported within a shower enclosure or above a bath or which form integrally one or more of a shelf or basket, soap dish, flannel rail, or step.

In broad terms in another aspect the invention comprises a method of forming a shower or bath wall liner panel including moulding in a sheet material two integral opposing non-planar formations from which when the panel is folded with a fold line down the panel and between the two moulded formations, one or more of a shelf, soap dish, flannel rail, or step may be supported, or which form integrally one or more of a shelf or basket, soap dish, flannel rail, or step, and forming a fold line down the panel between the two moulded formations in the panel.

In a typical wall liner panel of the invention formations are integrally moulded on either side of the fold line which defines the two sections of the panel and which will on installation of the panel sit in the intersecting corner of the two walls of a room in which a shower or bath of which the panel forms a part is installed. When the panel is installed the two moulded sections face each other on either side of the fold line, and separately formed shelf or basket, soap dish, flannel rail or step components may be supported in the corner of the shower from the two moulded sections, or alternatively the two moulded sections themselves may come together to form one or more shelves, soap dishes, flannel rails, or a step.

Alternatively a wall liner panel of the invention may be intended to line three walls of a shower enclosure or above a bath and may be divided into three sections by two fold lines down the panel with integral opposing non-planar formations from which one or more of a shelf, soap dish, flannel rail, or step may be supported, or which form integrally one or more of a shelf or basket, soap dish, flannel rail, or step, formed on either side of one or alternatively both fold lines down the panel, to provide shelves, soap dishes, flannel rails, and/or steps at one or both internal corners of the shower enclosure or over a bath.

In broad terms in a further aspect the invention comprises a shower or bath wall liner panel including panel sections on either side of a fold down the panel, and a non-planar formation integrally formed in the panel on one side of the fold from which after installation of the liner panel one or more of a shelf or basket, soap dish, flannel rail, or a step may be supported within a shower enclosure or above a bath.

BRIEF DESCRIPTION OF THE DRAWINGS

The invention is further described with reference to the accompanying drawings which show preferred forms of the invention by way of example, and in which.

DETAILED DESCRIPTION OF PREFERRED FORMS

Figure 1:
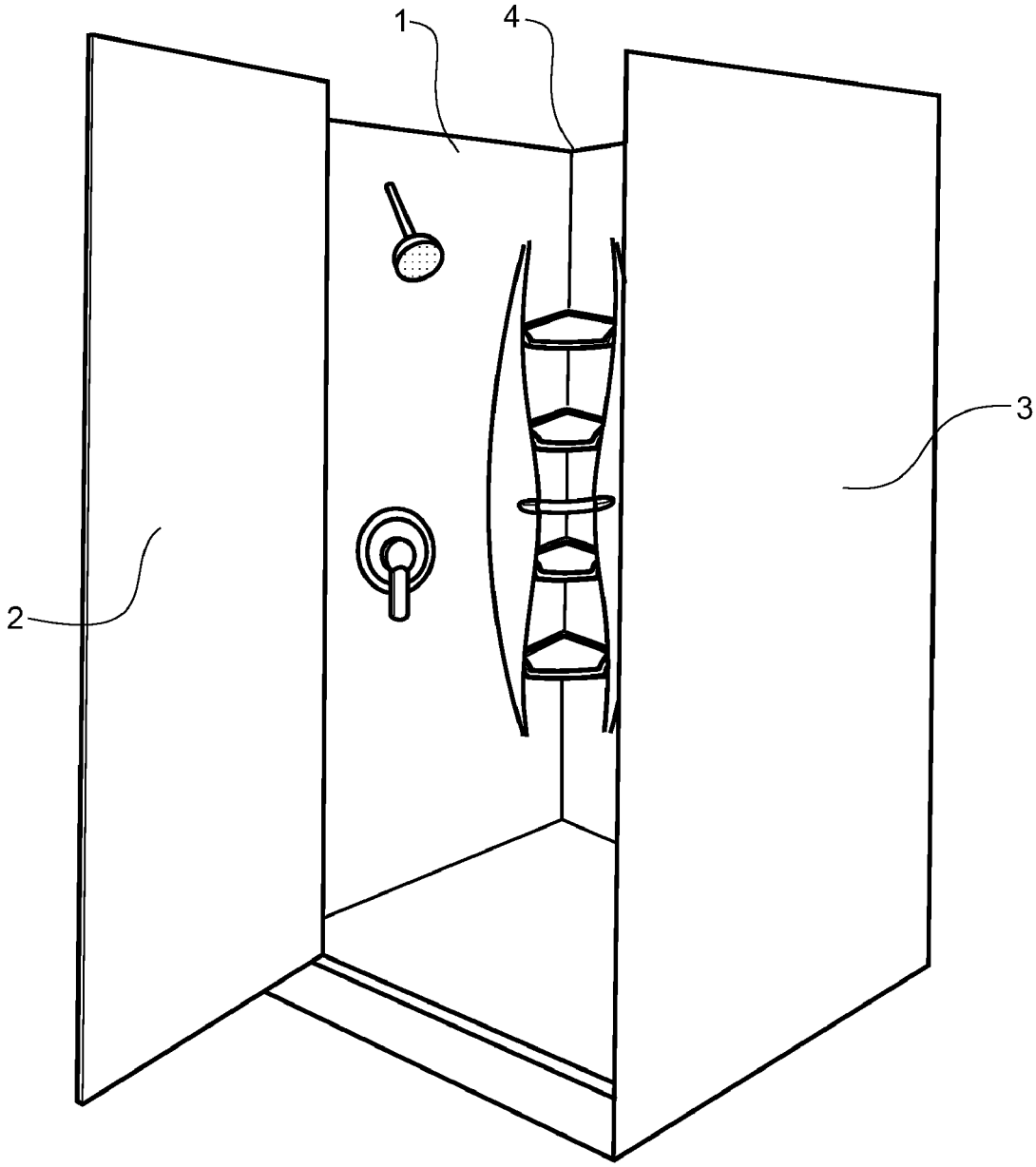
FIG. 1 shows an installed shower enclosure of which a shower or bath wall liner panel of the invention forms a part.
Figure 2:
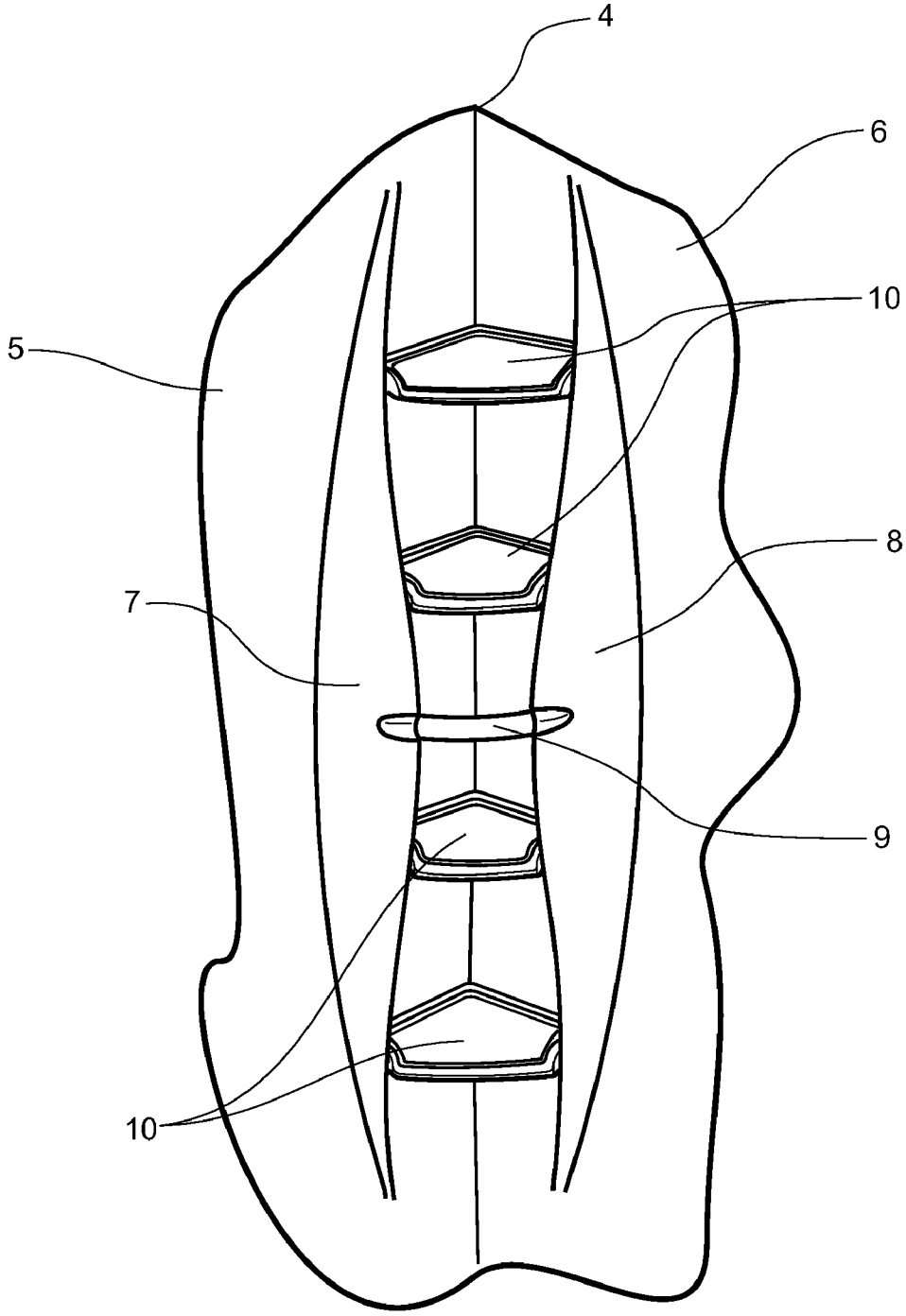
FIG. 2 is a close up view of the two opposing mould formations in the preferred form wall liner panel of the shower enclosure of FIG. 1, having four separate shelf parts fitted thereto.

FIG. 1 shows a shower enclosure incorporating a preferred form wall liner panel 1 which lines the corner walls against which a door 2 and return 3 are fitted to form a shower enclosure. The panel 1 is formed from a single flat sheet of material such as an acrylic material for example, in which at the factory the fold line 4 is formed thereby defining panel sections 5 and 6 on either side of the fold line 4.

Figure 6:
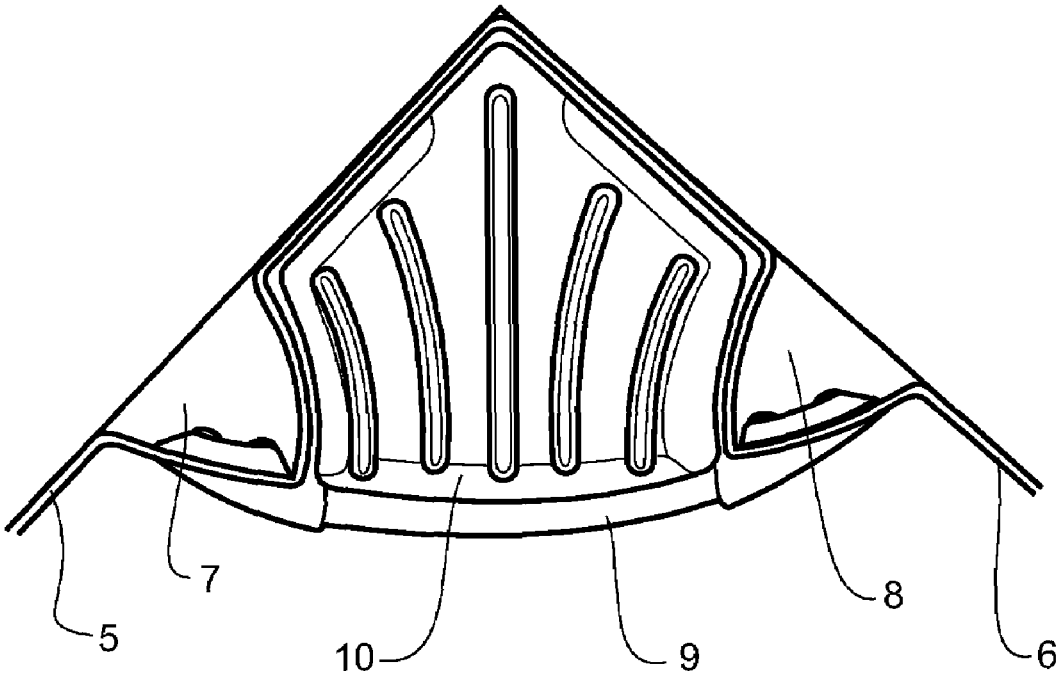

Opposing moulded sections, are integrally formed in the panel on either side of the fold line, which as more particularly shown in FIG. 3 support one or more shelf and/or soap dish and/or shelf/flannel rails and/or step parts 10 etc. FIG. 6 shows a shelf component from above which is supported on either side by moulded sections. The two moulded sections 7 and 8 on ether side of the fold line 4 may optionally be connected by a component 9 which also forms a handrail or hanging rail for hanging a flannel or a shampoo bottle or similar.

Figure 3A:
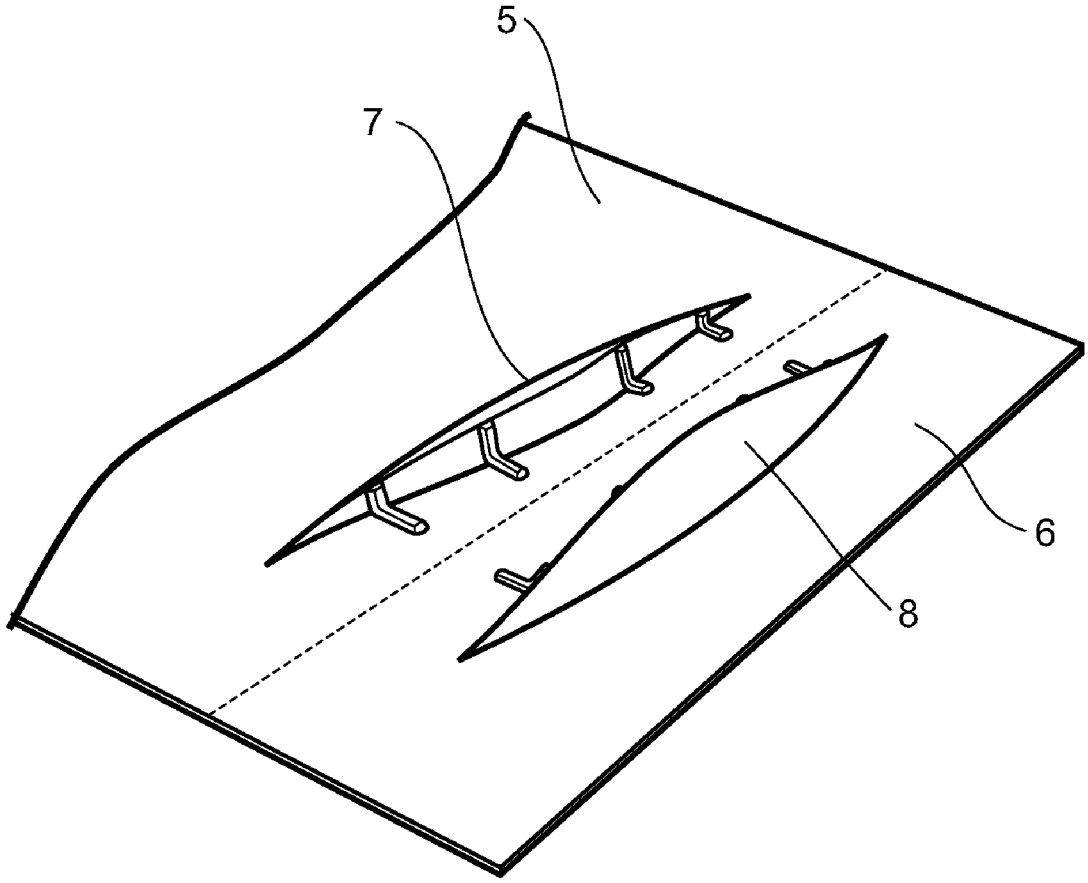
FIGS. 3*a* to 3*c* illustrate manufacture and packaging of a preferred form liner panel similar to that of FIGS. 1 and 2, FIGS. 4 and 5 show examples of other designs of moulded formations which may be formed in a wall liner panel of the invention to provide shelves or similar, FIG. 6 is a view from immediately above of a separately manufactured shelf component fitted in place and supported by the two moulded formations of the wall liner panel of FIGS. 1 and 2, and FIGS. 7*a* to 7*d* show designs for other forms of shelf, soap dish and shelf/flannel rail components which may be used with the wall liner panel of FIGS. 1 and 2.
Figure 3B:
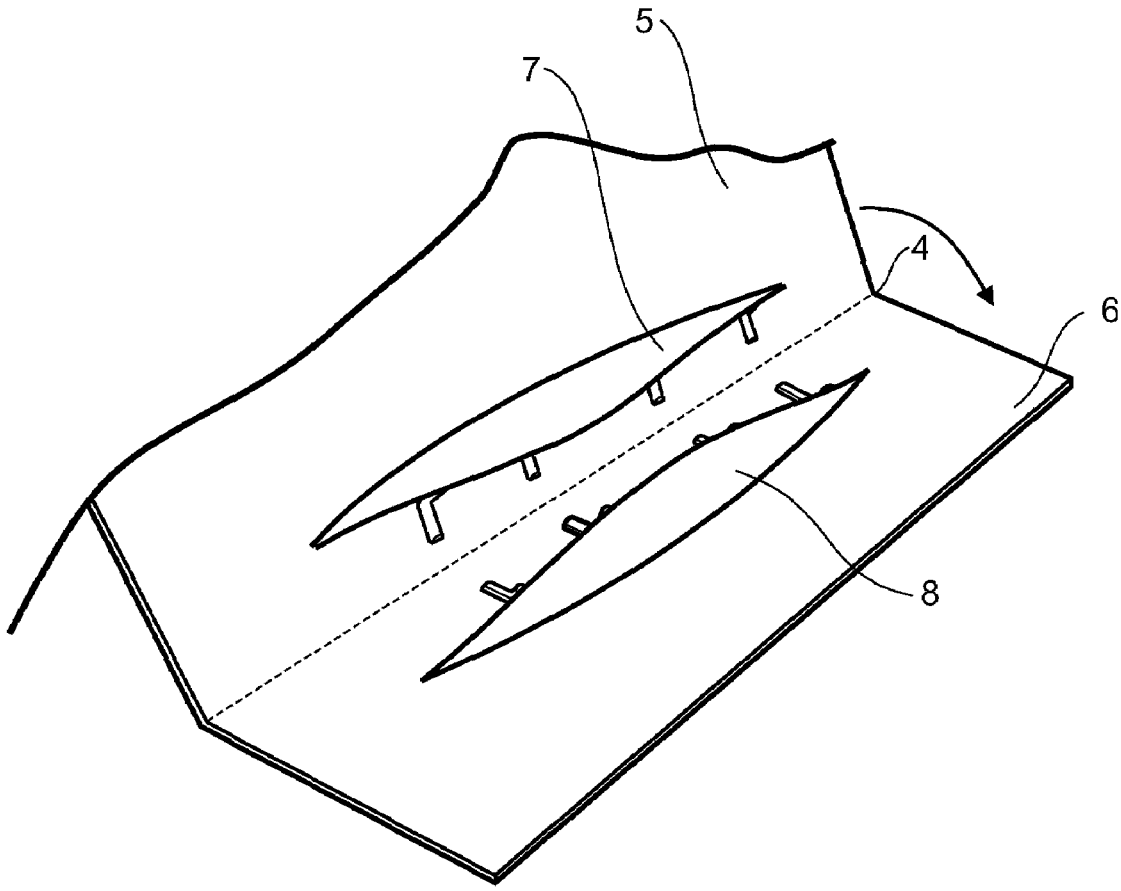
Figure 3C:
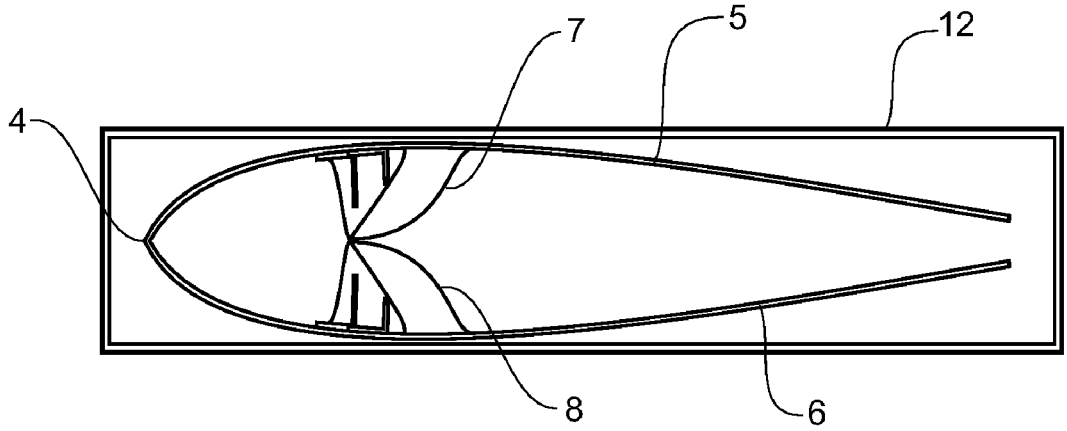

Referring to FIGS. 3*a* to 3*c,* in manufacture of the wall liner panel at a factory, first a sheet of acrylic premanufactured to a desired standard size or trimmed to size, is moulded typically by vacuum forming, to vacuum form or otherwise form the non-planar formations 7 and 8 in the flat sheet as shown in FIG. 3*a*. Then the sheet is heated to the extent necessary to soften the sheet so that it can be folded between the moulded sections 7 and 8, as shown in FIG. 3*b* and as is known in the art. Typically the sheet is thus folded to a 90° angle between the two panel sections 5 and 6. The sheet is allowed to cool, and may subsequently be cold flex-folded to occupy the smallest volume, and packaged in a flat carton 12, as shown in FIG. 3*c*. Alternatively the wall liner panel folded to the shape shown in FIG. 3*c* may be for example bubble wrapped and then stretch or shrink wrapped for example, instead of being packed in a carton.

Subsequently on site the wall liner panel is unpackaged, and installed in place in the intersecting corner of two walls of a room in which a shower or bath is to be installed. Typically the panel is installed by gluing to backing panels attached to the framing members in the corner of the room, or directly to the framing members. The door and one or more return panels are fitted to form the completed shower enclosure as shown in FIG. 1, for example.

Figure 4:
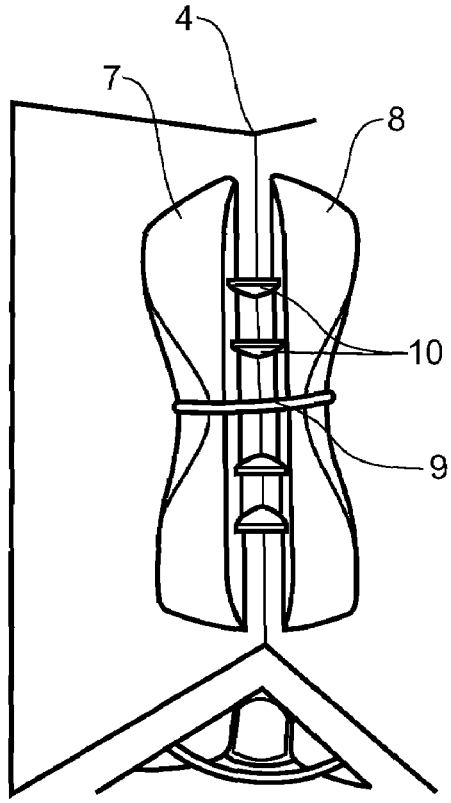
Figure 5:
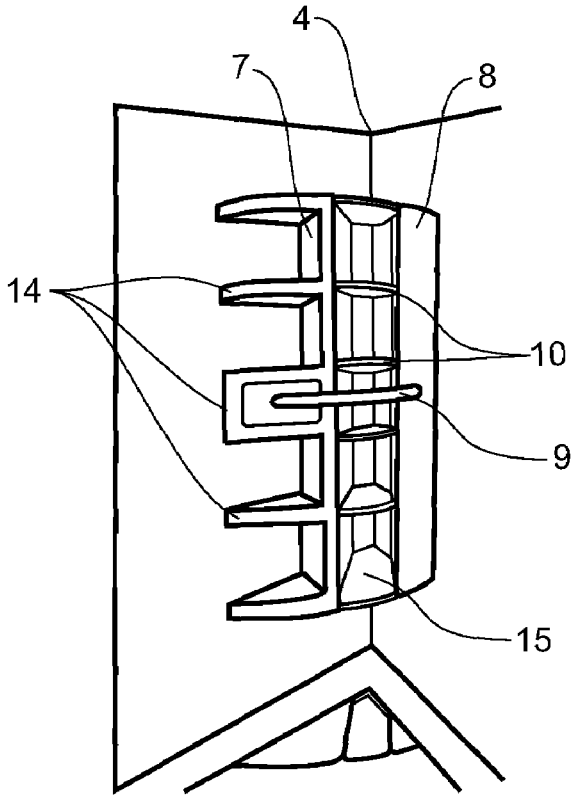

FIGS. 4 and 5 show examples of wall liner panels having other shapes of the moulded sections 7 and 8. In FIG. 5 the moulded section 7 on one side provides additional integrally moulded shelves 14 on one side as shown.

Optionally shower jets may be positioned in either of the moulded sections 7 and 8 or equivalent.

Figure 7A:
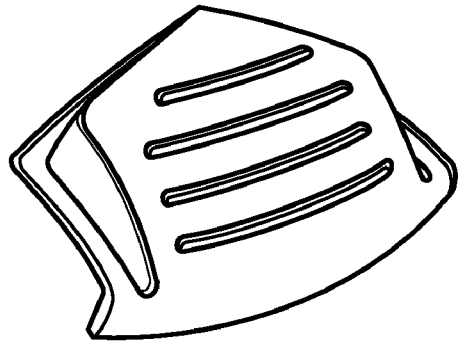
Figure 7B:
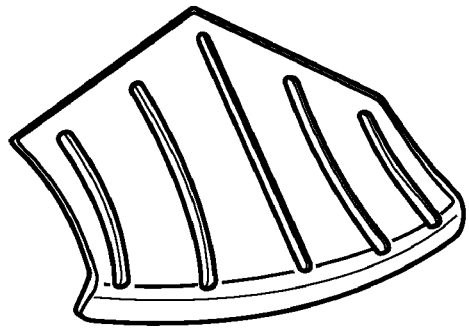
Figure 7C:
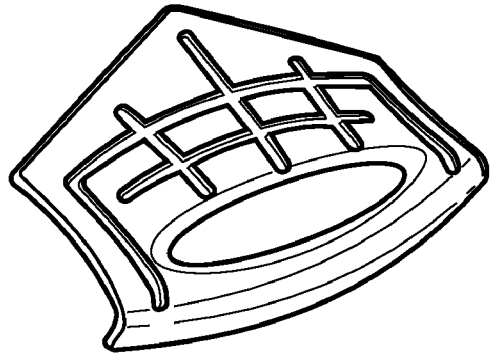
Figure 7D:
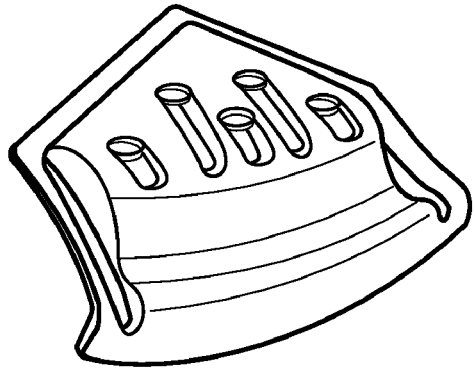

FIG. 7*a* shows from below possible designs for a soap dish component, and FIGS. 7*b* to 7*d* show from below designs for shelf components. The shelf component of FIG. 7*c* incorporates an aperture to define a flannel rail and the shelf component of FIG. 7*d* incorporates drain holes. In each case the components incorporate side edge portions via which the components when fitted to the installed shower wall panel will be supported from the moulded sections 7 and 8. The components of any desired form, may be moulded from a plastics material or any other suitable material such as a metal by die casting for example, and may alternatively include a wire shelf or shelves or basket(s). Preferably the components etc are removable for cleaning rather than being permanently attached in position.

In an alternative form of a wall liner panel of the invention, instead of two moulded sections 7 and 8 being formed one on either side of fold line 4, a single moulded section may be formed on one side of the wall liner panel only, to which may optionally be secured a shelf, soap dish component, or similar in a cantilever arrangement.

Alternatively a wall liner panel of the invention may be intended to line three walls of a shower enclosure or above a bath and may be divided into three sections by two fold lines down the panel with integral opposing non-planar formations from which one or more or a shelf, soap dish, flannel rail, or step may be supported formed on either side of the fold line down the panel, or alternatively both fold lines at one or both internal corners of the shower enclosure or over a bath.

The foregoing describes the invention including a preferred forms thereof. Alterations and modifications as will be obvious to those skilled in the art are intended to be incorporated in the scope hereof.

I claim:

1. A unitary shower or bath wall liner panel including panel sections on either side of a fold in the panel, about which fold the panel sections can resiliently flex from a relaxed condition of the panel, towards one another, a first non-planar formation integrally formed in the panel on a first side of the fold and spaced away from the fold, and a second non-planar formation separate from said first formation and integrally formed in the panel on a second and opposite side of the fold and spaced away from the fold and opposing said first formation, said first and second formations being spaced away from each other at least when the panel is in said relaxed condition of the panel, one or more of a shelf, soap dish, flannel rail, or a step being supportable between said first and second formations after installation of the liner panel as part of a shower enclosure or above a bath, or said first and second formations being adapted to after installation of the liner panel as part of a shower enclosure or above a bath form one or more of a shelf or basket, soap dish, flannel rail, or step integral in the liner panel within the shower enclosure or above the bath, the panel being sufficiently resiliently flexible that the panel sections can be resiliently flex-folded from said relaxed condition of the panel to move said panel sections including said first and second formations towards one another.

2. A shower or bath wall liner panel according to claim 1 for lining three walls of a shower enclosure or above a bath and wherein the wall liner panel is divided into three panel sections by two generally parallel spaced folds in the panel, about each of which folds two of said panel sections, one on either side of the fold, can resiliently flex towards or away from one another from a relaxed condition of the panel, a first non-planar formation integrally formed in the panel on a first side of at least one of the folds and spaced away from the fold, and a second non-planar formation separate from said first formation and integrally formed in the panel on a second and opposite side of the said fold and spaced away from the fold and opposing said first formation, said first and second formations being spaced away from each other at least when the panel is in said relaxed condition of the panel, one or more of a shelf, soap dish, flannel rail, or a step being supportable between said first and second formations after installation of the liner panel as part of a shower enclosure or above a bath, or said first and second formations being adapted to after installation of the liner panel as part of a shower enclosure or above a bath form one or more of a shelf or basket, soap dish, flannel rail, or step integral in the liner panel within the shower enclosure or above the bath, the panel being sufficiently resiliently flexible that the panel sections on either side of said at least one of the folds can be resiliently flex-folded from said relaxed condition of the panel to move said panel sections including said first and second non-planar formations towards one another.

3. A shower or bath wall liner panel according to claim 1 also including a hand rail or hanging rail for connecting between said formations.

4. A shower or bath wall liner panel according to claim 1 which is formed from a thermoplastic material.

5. A shower or bath wall liner panel according to claim 1, including at least one separately formed shelf or basket, soap dish, flannel rail or step component supportable between said first and second formations after installation of the liner panel as part of a shower enclosure or above a bath.

6. A shower or bath wall liner panel according to claim 1 which is formed from a thermoplastic material.

7. A shower or bath wall liner panel according to claim 1 in a package with the panel resiliently flex-folded about said fold to an extent that said first and second non-planar formations are moved closer towards one another than when the panel is in its relaxed condition, the package retaining the wall liner panel in said flex-folded position until it is removed from the package.

8. A method of forming a shower or bath wall liner panel including forming in a single sheet of material two separate integral opposing non-planar formations spaced from one another, from which when the panel is folded with a fold line in the panel and between the two separate moulded formations and to divide the panel into two opposing panel sections, one or more of a shelf, soap dish, flannel rail, or step can be supported, or which form integrally one or more of a shelf or basket, soap dish, flannel rail, or step, and forming said fold line down the panel between the two moulded formations in the panel.

9. A method according to claim 8 including forming said formations so that they are shaped and positioned such that when the panel is installed the two formations will face each other on either side of the fold line, and separately formed shelf or basket, soap dish, flannel rail or step components can be supported in a corner of the shower from the two moulded sections.

10. A method according to claim 8 including forming said formations so that they are shaped and positioned so that when the panel is installed the two formations come together to form one or more shelves, soap dishes, flannel rails, or a step.

11. A method according to claim 8 also providing a hand rail or hanging rail for connecting between said formations.

12. A method according to claim 8 including thermoforming said formations.

13. A method according to claim 8 including subsequently flex-folding the panel about said fold line to occupy a smaller volume and packaging the wall liner panel while in said flex-folded condition in a package which will retain the wall liner panel in said flex-folded position until it is removed from the package.

* * * * *